US005379891A

United States Patent [19]

Coleman

[11] Patent Number: 5,379,891

[45] Date of Patent: Jan. 10, 1995

[54] FOOTSTOOL APPARATUS ADAPTED FOR BEING CARRIED IN A GUITAR CASE, AND GUITAR CARRYING CASE APPARATUS WITH SAME

[76] Inventor: Jeffrey A. Coleman, 5121 W. Camino de la Amapola, Tucson, Ariz. 85745

[21] Appl. No.: 156,691

[22] Filed: Nov. 24, 1993

[51] Int. Cl.[6] ..... A45C 11/00

[52] U.S. Cl. ..... 206/314; 206/216; 108/119; 297/423.45; 297/423.46

[58] Field of Search ..... 206/314, 14, 216, 591, 206/592; 108/119; 312/235.1, 235.2, 235.3; 297/423.44, 423.45, 423.46, 423.41, 423.39

[56] References Cited

U.S. PATENT DOCUMENTS

| | | | |
|---|---|---|---|
| 544,603 | 8/1895 | Thompson | 108/119 |
| 1,448,253 | 3/1923 | Bodker | 312/235.3 X |
| 2,226,900 | 12/1940 | Dickerson | 206/314 |
| 3,080,202 | 3/1963 | Franzene | 108/119 X |
| 3,083,053 | 3/1963 | Dorsey | 312/235.1 X |
| 3,227,491 | 1/1966 | Conrad | 297/423.41 X |
| 3,271,075 | 9/1966 | Good | 297/423.41 |
| 3,326,359 | 6/1967 | Katz | 206/14 |
| 3,653,154 | 4/1972 | Drabert et al. | 297/423.45 |
| 4,147,254 | 4/1979 | Bruce | 206/314 |
| 4,215,778 | 8/1980 | Kovins | 206/314 |
| 4,223,785 | 9/1980 | Jacques | 206/314 |
| 4,296,694 | 10/1981 | Kobayashi | 297/423.44 X |
| 4,544,203 | 10/1985 | Younger et al. | 297/423.41 X |
| 5,086,711 | 2/1992 | Matthews | 108/119 |

OTHER PUBLICATIONS

Acoustic Guitar Magazine Nov./Dec. 1993 No. 21, p. 90.

*Primary Examiner*—Paul T. Sewell
*Assistant Examiner*—Ted Kavanaugh
*Attorney, Agent, or Firm*—Victor Flores

[57] ABSTRACT

A footstool for use by a guitar player. The footstool includes a foot support member, a first leg structure that is attached to the foot support member and delineates a compartment beneath the foot support member. The foot support member and the first leg support member are designed having a composite shape, such that when the footstool is inverted, the footstool conforms to, and facilitates being enclosed within a neck-end of a guitar carrying case. The footstool also includes a second leg structure designed for attachment within the compartment and is intended for use as an elevation adjustment mechanical arrangement for accommodating the guitar player's desired playing position. The compartment's length, depth and width are sized for receiving, and facilitating an unobstructed placement of the neck end (tuning peg end) of a guitar in the guitar carrying case. The footstool has industrial application for use in fitting the aftermarket traditional guitar cases, or an industrial application as a newly manufactured guitar case having the footstool as a removable part of the guitar case.

4 Claims, 2 Drawing Sheets

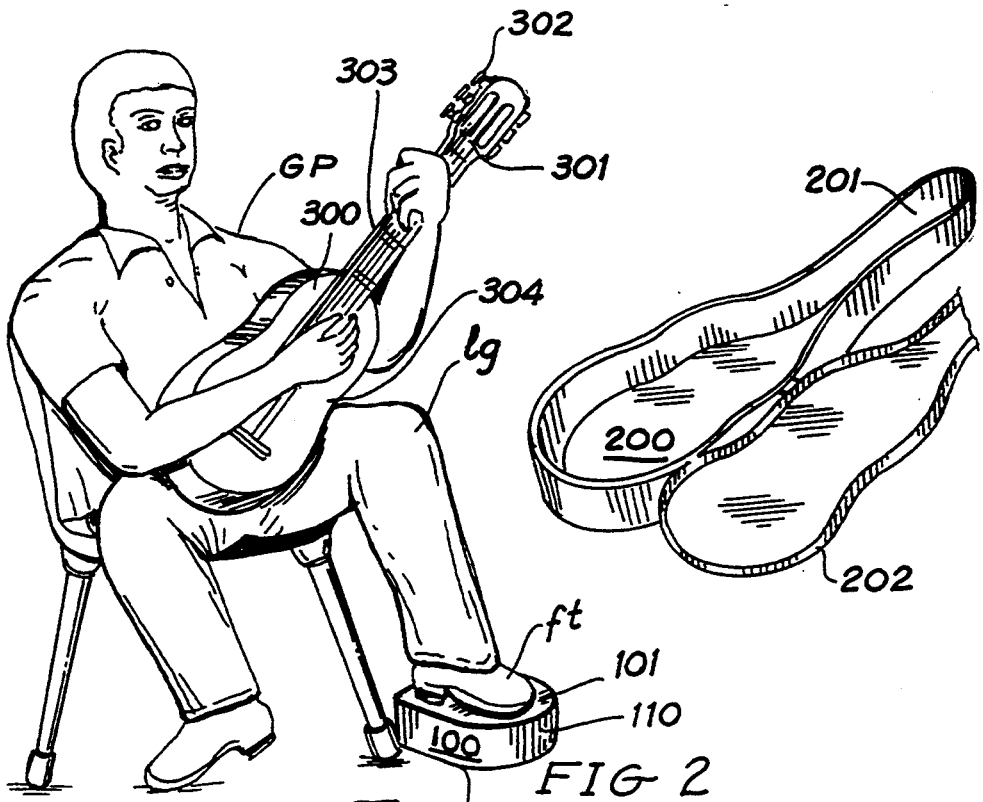
FIG. 2
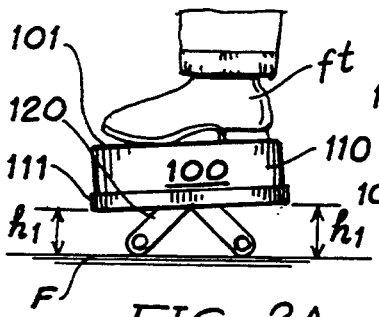
FIG. 2A
FIG. 2B
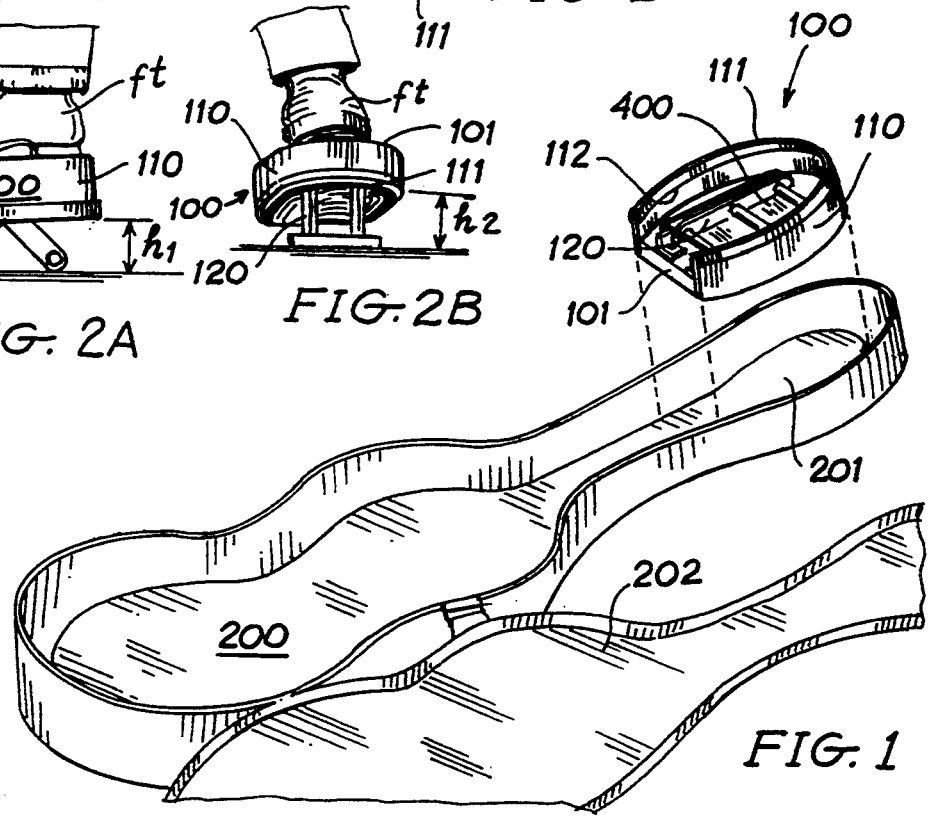
FIG. 1

FOOTSTOOL APPARATUS ADAPTED FOR BEING CARRIED IN A GUITAR CASE, AND GUITAR CARRYING CASE APPARATUS WITH SAME

FIELD OF THE INVENTION

The present invention relates to footstools. More particularly the present invention relates to footstools and associated structure that facilitates the footstool being stored and carried. Even more particularly, the present invention relates to footstools used by guitar players, and associated structure that facilitates the footstool being stored and carried.

BACKGROUND OF THE INVENTION

Footstool structures are known, in particular footstool structures for use by guitar players to elevate a foot and leg to provide a comfortable rest position for the guitar while playing the instrument. The known footstools for use while playing the guitar are those that provide a foot support platform and a crisscross mechanical arrangement that adjusts the height of the foot support platform to a comfortable position as desired by the guitar player. These known devices are carried by means of folding, collapsing and securement of the crisscross mechanical arrangement beneath the foot support platform. These footstools are generally loosely carried by the guitar player, separate from the guitar carrying case, and stored close-by, but typically not within, the guitar carrying case. The typical guitar case is designed to primarily carry the guitar with a compartment provided beneath the fret board carrying portion for strings and miscellaneous small items. An example of non-typical guitar cases which have larger auxiliary compartments is a guitar case marketed by Mark Leaf Case Co. of McPherson Kansas. The guitar carrying case design provides an elongate case section for accommodating storage of the guitar's fretboard and neck-end. Typically, the elongate case section is formed having a depth that is substantially greater than required by the guitar's fretboard, neck and tuning pegs. The extra depth in the elongate case section results in available space for the aforementioned compartment for string, etc., and still leaving additional unused space. To applicant's knowledge footstools have not been designed to fit in the elongate case section, especially in the distal neck-end portion of a guitar carrying case. The absence of such footstools has resulted in an inconvenience to a guitar player having to separately carry and keep track of an important tool.

Thus, a need is seen to exist for a footstool for use by a guitar player, which is designed such that it can be carried in a traditional guitar carrying case.

A need is see to exist for a footstool for use by guitar players, designed as in the foregoing, and also provided with vertical height adjustment structure.

A need is seen to exist for a guitar carrying case designed with a footstool member, invertedly inserted in the distal neck portion of the carrying case.

SUMMARY OF THE INVENTION

Accordingly, the primary object of the present invention is to provide a footstool, for use by a guitar player, which is designed such that it can be carried and stored in a traditional guitar carrying case designed for primarily carrying a guitar.

Another object of the present invention is to provide a footstool for use by guitar players, designed as in the foregoing primary objective, and also provided with vertical height adjustment structure.

A related object of the present invention is to provide a guitar carrying case designed to primarily carry a guitar, but also designed to include a footstool member inserted in the distal neck portion of the carrying case.

The foregoing objects are accomplished by providing a footstool apparatus for use by a guitar player, said apparatus comprising a foot support member, a first leg structure attached to said foot support member. The first leg structure delineates a compartment beneath the foot support member, and also includes a second leg structure designed for attachment within the compartment. The second leg structure comprises an elevation adjustment mechanical arrangement for accommodating the guitar player's desired playing position. The footstool apparatus of the present invention is designed having a composite shape, such that when it is inverted, said composite shape conforms to, and facilitates enclosure within an interior portion of a neck-end of a guitar carrying case. The compartment's dimensions, i.e. the length, depth and width are sized for receiving, and facilitating an unobstructed placement of a neck end of a guitar in said guitar carrying case.

The footstool of the present invention has industrial application for use in fitting the aftermarket traditional guitar cases, or an industrial application as a newly manufactured guitar case, wherein the footstool comprises a removable component of the guitar case.

Therefore, to the accomplishments of the foregoing objects, the invention consists of the foregoing features hereinafter fully described and particularly pointed out in the claims, the accompanying drawings and the following disclosure describing in detail the invention, such drawings and disclosure illustrating the preferred embodiment in which the invention may be practiced.

BRIEF DESCRIPTION OF THE DRAWINGS

FIG. 1 is a view of the present invention illustrated as a guitar carrying case adapted with a footstool member in accordance with the present invention.

FIG. 2 is a view of the footstool of the present invention removed from a guitar carrying case, illustrated with a first leg structure and being utilized by a guitar player to elevate a foot to assume a comfortable playing position.

FIG. 2A is a view of the present invention illustrating the second leg structure adjusted an equal distance from the floor.

FIG. 2B is a view of the present invention illustrating the second leg structure adjusted an unequal distances from the floor to achieve an alternate height adjustment setting.

DESCRIPTION OF THE PREFERRED EMBODIMENT

Figure 3:
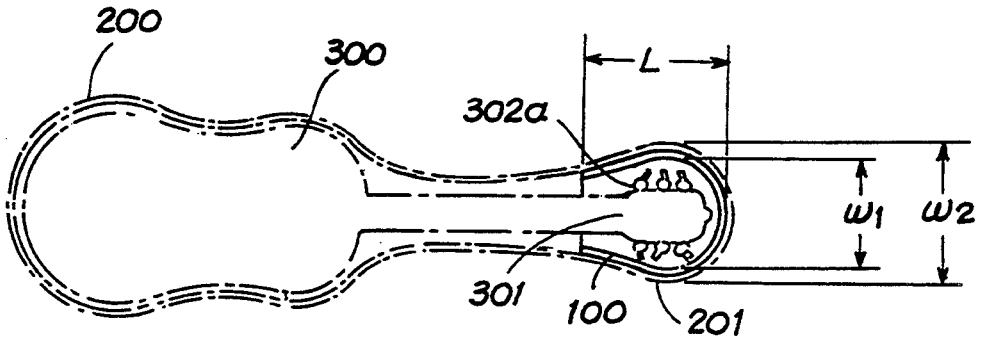
FIG. 3 is a top view of the present invention illustrating the footstool member stored away in a neck portion of the guitar carrying case, and also illustrating an unobstructed placement of a guitar having tuning pegs extending laterally.

FIG. 1. shows a footstool 100 in accordance with the present invention for being carried in a distal neck-end 201 of a guitar carrying case 200 and covered by the case lid 202. Footstool 100 is shown in an inverted position for utilizing the unused space that is typically found beneath the tuning pegs of a guitar when the guitar is placed in the carrying case. As depicted in FIG. 1, footstool 100 comprises a first leg structure 110 having a wall portion 112, provided with an antiskid U-shaped extrusion 111, attached to the periphery of a foot support member 101, and forming a compartment 400. Compartment 400 creates ample space for accommodating placement of the guitar's neck end, including the tuning pegs. The space created by compartment 400 is such that a second leg structure 120 can be attached to the underside of the plateform 101 and still have clearance for the guitar's tuning pegs.

FIG. 2 shows a guitar player GP playing a guitar 300 and utilizing a footstool 100 in accordance with the present invention. Traditionally, a GP sits and supports the guitar on an upper leg lg that is elevated by placement of a foot ft upon a foot support platform member 101 of footstool 100 that is displaced from the floor F by a first leg structure 110. Guitar 300 comprises a distal neck end 301 upon which are mounted the tuning pegs 302, the neck 301 (possibly referred to as the neck and head portion) connects to a fretboard 303 which connects to the guitar body 304. FIG. 2 also shows the guitar carrying case 200 with distal neck-end portion 201 and lid 202.

Since the use of a footstool accomplishes a GP's comfort objective, FIGS. 2A and 2B illustrates footstool 100 with alternative height adjustment positions to that shown in FIG. 2, both FIGS. 2A and 2B illustrating the utilization of the second leg structure 120. FIG. 2A illustrates second leg structure 120 in the form of a crisscross mechanical arrangement adjusted to evenly elevate platform 101 an equal height h1 from a floor F. FIG. 2B illustrates second leg structure 120 in the same crisscross mechanical arrangement adjusted to tilt up the toe-end of foot ft an amount h2.

FIG. 3 shows a top view of a guitar 300 enclosed in a carrying case 200. FIG. 3 also shows footstool member 100 installed within case neck-end space 201 in accordance with the present invention. As depicted, footstool 100 is formed having a length L that matches the available length in the case neck-end 201 beyond a presently available compartment (not shown) that is used for guitar strings and other miscellaneous small items. Footstool 100 is designed having a width w1 that is less than the internal width of neck-end case portion 201. Width 201 is selected such that, in the event that the guitar tuning pegs 302*a* are of the type that extend laterally from the guitar neck ends adequate clearance is maintained for an unobstructed placement of the guitar.

Figure 4:
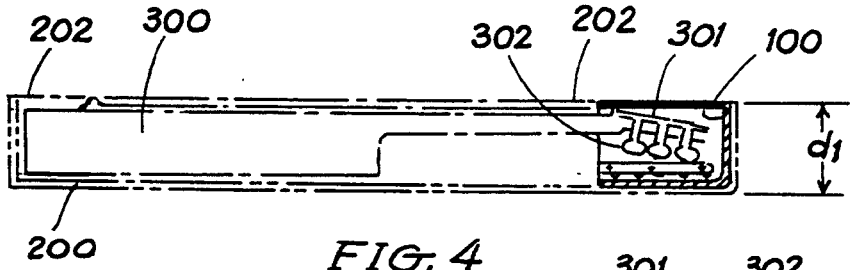
FIG. 4 is a side view of the present invention illustrating the footstool member stowed away in a neck portion of the guitar carrying case, and also illustrating an unobstructed placement of a guitar having tuning pegs extending downwardly from the guitar's neck.

FIG. 4 is a side view showing the carrying case 200 having an overall height dimension d1 to include the enclosure space of lid 202. The height d1 is a target reference dimension that can be used to determine the height d2 of footstool 100, see FIG. 5. FIG. 4 shows footstool 100 stowed away in neck portion 201 of guitar carrying case 200, and illustrating an unobstructed placement of a guitar 300 having tuning pegs 302 extending downwardly from guitar neck 301.

Figure 5:
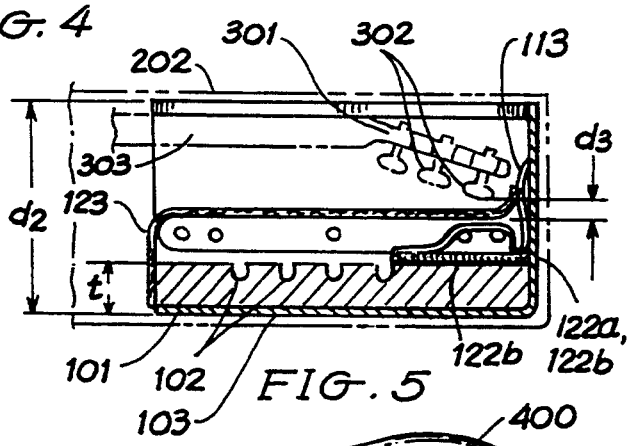
FIG. 5 shows an enlarged view of the neck-end of the guitar carrying case and footstool application shown in FIG. 4, illustrating, in particular, the clearance below the tuning pegs, and the overall clearance inside the case's neck portion with the footstool completely stowed inside the guitar carrying case.

FIG. 5 shows an enlarged view of the neck-end of the guitar carrying case and footstool application shown in FIG. 4, illustrating, in particular, the clearance d3 below the tuning pegs 302 and, as noted earlier, the overall footstool height d2 completely stowed inside the guitar carrying case. The height d2 of footstool 100 may be such that wall 112 may extend into a space in lid 202 to achieve the complete stowed away objective. FIG. 5 shows second leg structure 120 secured to the bottom end 101*a* of platform 101. As shown, second leg structure 120 is preferably covered with a fabric cover 123 that complements the interior fabric lining of the guitar case. A lift tab 113 is provided for aiding removal of the footstool 100 from within the case. Further, strips of mating hook and loop material 122*a*, 122*b* are also provided as part of the design, and aid in securing the second leg structure within compartment 400 by attachment to wall 112 and to the underside 101*a* of platform 101. As depicted in FIG. 5, and by example only, the bottom end 101*a* is formed with adjustment grooves 102 that function as stops for a cross member of leg structure 120 during selection of a desired vertical height. FIG. 5 also shows foot support platform 101 having a thickness t and provided on its top surface with a non-skid material 103 to assure good footage during use.

Figure 6:
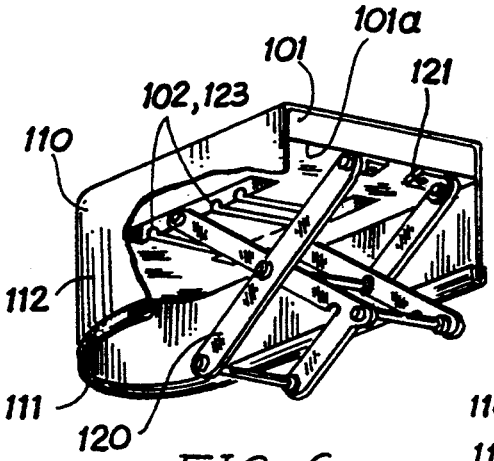
FIG. 6 is an upright view of the footstool apparatus of the present invention, illustrating in cutaway, the adjustable second leg structure attached to the underside of the foot support platform of the footstool and being in a functional extended crisscross position.

FIG. 6 is an upright view of footstool 100 illustrating in cutaway, the adjustable second leg structure 120, shown by example as a crisscross mechanical structure. As depicted, the crisscross mechanical structure is shown in an extended state by engagement of a cross member 123 to a selected one of the adjustment grooves 102. FIG. 6 shows the previously discussed foot platform 101 and first leg structure 110 with wall 112 and antiskid U-shaped extrusion 111, essentially forming the legs of footstool 110 when the second leg structure 120 is not being used.

Figure 7:
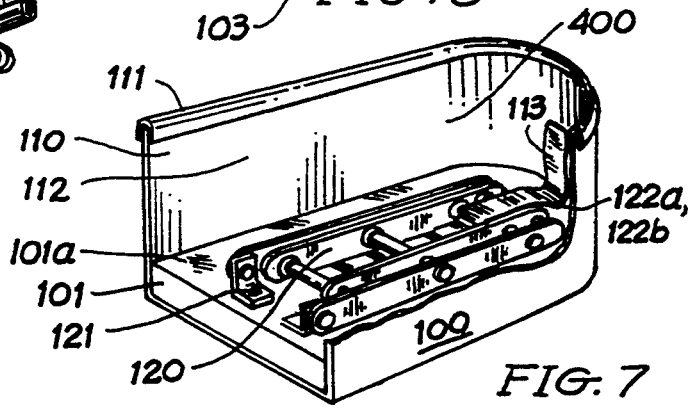
FIG. 7 is an inverted view of the footstool apparatus of the present invention, illustrating in cutaway, the adjustable second leg structure attached to the underside of the foot support platform of the footstool and being in a non-function stored position.

FIG. 7 is an inverted view of the footstool 100 illustrating in cutaway, the adjustable second leg structure 120 attached to the underside 101*a* of the foot support platform 101 and shown in a non-functional; folded and stored position. Second leg structure 120 is shown fixedly attached at one end to the underside 101*a* by means of mounting brackets 121, and detachably attached at another end by means of the hook and loop mating strips 122*a* and 122*b*. Lift tab 113, which is used to remove footstool 100 from the case, is shown attached to wall 112. As previously discussed, and as depicted in FIG. 7, first leg structure 110 is preferably formed by a walled structure 112 that creates a compartment 400 which facilitates continued placement of the neck 301 of a guitar 300 within guitar carrying case 200 and associated neck-end space 201.

Therefore, while the present invention has been shown and described herein in what is believed to be the most practical and preferred embodiment, it is recognized that departures can be made therefrom, within the scope of the invention, which scope is therefore not to be limited to the details disclosed herein, but is to be accorded the full scope of the claims, so as to embrace any, and all equivalent apparatus.

I claim:

1. A guitar carrying case apparatus, said apparatus comprising:

(a) a carrying case member having a neck-end portion;

(b) a footstool member in combination with said carrying case member for use by a guitar player, said footstool member being a removable structure formed for being stored within said neck-end portion, said footstool member comprising a platform portion, and a first leg structure attached to said platform portion, said first leg structure delineating a compartment beneath said platform portion; and (c) a second leg structure disposed within said compartment, said second leg structure comprising an elevation adjustment mechanical arrangement for accommodating said guitar player's desired playing position.

2. A guitar carrying case apparatus as described in claim 1, wherein:

said second leg structure being attached to an underside of said platform portion, and said compartment is provided with a fabric that complements an interior of said carrying case member and that covers and secures said second leg structure.

3. A guitar carrying case apparatus as described in claim 2 wherein:

said elevation adjustment mechanical arrangement comprises a crisscross mechanical arrangement, and said compartment is provided with a fabric that complements an interior of said carrying case member and that covers and secures said second leg structure.

4. A guitar carrying case apparatus, said apparatus comprising:

(a) a carrying case member having a neck-end portion;

(b) a footstool member in combination with said carrying case member for use by a guitar player, said footstool member being a removable structure formed for being stored within said neck-end portion, said footstool member comprising:

a platform portion, a first leg structure attached to said platform portion, said first leg structure being a walled structure orthogonally attached to an underside of said platform portion and delineating a compartment beneath said platform portion, and a second leg structure, said second leg structure being attached to an underside of said platform portion and comprising an elevation adjustment mechanical arrangement for accommodating said guitar player's desired playing position, said compartment being provided with a fabric that complements an interior of said carrying case member and that covers and secures said second leg structure.

* * * * *